United States Patent [19]

Viator, Sr.

[11] Patent Number: 4,697,174

[45] Date of Patent: Sep. 29, 1987

[54] BALL ACTUATED ALARM DEVICE

[76] Inventor: John R. Viator, Sr., 530 Freetown Rd., New Iberia, La. 70560

[21] Appl. No.: 786,325

[22] Filed: Oct. 10, 1985

[51] Int. Cl.[4] ..... G08B 21/00; H01H 35/02

[52] U.S. Cl. ..... 340/689; 33/366; 200/61.52; 200/DIG. 29

[58] Field of Search ..... 340/689, 571, 685; 33/366; 307/121; 200/DIG. 29, 61.11, 61.45 R, 61.52

[56] References Cited

U.S. PATENT DOCUMENTS

| | | | |
|---|---|---|---|
| 2,794,084 | 5/1957 | Segoni | 340/689 X |
| 3,548,400 | 12/1970 | Boyd et al. | 340/689 X |
| 4,001,185 | 1/1977 | Mitsui et al. | 200/61.52 X |
| 4,107,545 | 8/1978 | Gittelis | 307/121 |
| 4,144,422 | 3/1979 | Ramos | 200/61.52 |
| 4,278,854 | 7/1981 | Krause | 340/689 X |
| 4,459,115 | 7/1984 | Ballard | 340/689 X |
| 4,493,155 | 1/1985 | Comeau et al. | 33/366 |

FOREIGN PATENT DOCUMENTS

| | | | |
|---|---|---|---|
| 1415999 | 9/1965 | France | 200/DIG. 29 |
| 492595 | 3/1954 | Italy | 200/DIG. 29 |

*Primary Examiner*—Glen R. Swann, III
*Assistant Examiner*—Thomas J. Mullen, Jr.
*Attorney, Agent, or Firm*—Keaty & Keaty

[57] ABSTRACT

There are many instances, specifically supportated offshore platforms, where the initiation of catastrophic tilting should be detected and personnel warned. Conventional tilt detection switches, while capable of detecting a tilt condition, are prone to false alarms due to minor deviations from normal conditions. The disclosed system employs a free rolling ball member on a normally horizontal planar surface. This surface is divided into regions by elongated protuberances which separate the ball from a switch capable of being closed by contact with the ball. The ball is prevented from actuating the switch on the occurrence of minor deviations of the planar surface by the protuberances, but upon substantial tilting, the switch can be actuated by the ball rolling over the protuberances and contacting the switch.

16 Claims, 8 Drawing Figures

BALL ACTUATED ALARM DEVICE

BACKGROUND OF THE INVENTION

1. Field of the Invention

The present invention generally relates to tilt indicators and more particularly to tilt indicators for use on ships, oil rigs and platforms as well as bridges, structures on land and scaffolding which will activate an alarm should the vessel or platform tilt more than a predetermined degree.

2. General Discussion of the Background

Tilting and capsizing has been a big problem in the maritime industries. Consequently, there has been a need to warn persons on structures on the water as well as persons on buckling and tilting structures on land at the earliest possible moment of any danger of tilting, swinging or capsizing and thereby saving life and property.

There exist several devices in the prior art which detect tilting of objects. These include: Boyd's Ships Trim Indicator (U.S. Pat. No. 3,548,400); Schneider's Tilt Responsive Inertia Switch With Printed Circuit And Movable Ball Contact (U.S. Pat. No. 3,733,447); Chisman's Automatic Gravity Ignition Cut Out for Tractors (U.S. Pat. No. 1,414,932); Florin's Position Sensitive Mercury Switch (U.S. Pat. No. 4,348,562); Jones' Short Circuit Cut Out Switch For Tractors (U.S. Pat. No. 3,083,275); Hall's Inclination Responsive Electrical Switch (U.S. Pat. No. 3,161,737); Segoni's Accident Signaling Device (U.S. Pat. No. 2,794,084); and Gebhardt's Alarmvorrichtung Zum Anzeigen des Erschutterns Oder Zerbrechens Von Fensterscheiben (Germany No. 384,082).

The above patented devices do not disclose a tilt detection device with protuberances projecting from a substantially flatly resting floor plate over which a ball or similar object may travel in case of a tilt to complete a circuit, thereby triggering an alarm to warn those in the vicinity of a dangerous tilt.

The prior art also does not disclose an alarm device which will not be triggered by a slight tilt or sudden shock. Furthermore, the prior art does not disclose a waterproof tilt indication device.

SUMMARY OF THE INVENTION

The applicant's ball-actuated alarm device solves the long-existing problems of the prior art by having a corrective feature which will prevent the inadvertent triggering of the alarm after a small tilt or inadvertent shock. Furthermore, the invention is usable below the water surface since it is waterproof. To achieve the objects of providing a corrective feature and waterproof quality, the present invention, a device for detecting tilting of a structure, comprises a rectangular floor plate divided into three regions by protuberances. A metal ball placed in the first region having a diameter sufficiently greater than the height of the first protuberance, moves over the protuberances into the second and then the third region during a tilt to close a circuit, triggering the alarm connected to the circuit. During a small tilt or sudden shock, the ball will travel into the second region only and will not trigger the alarm. This second region provides a "correction buffer" to use against the inadvertent setting of the alarm.

Another feature of the applicant's invention is its waterproof quality and strength of the container enclosing the floor plate. The container is made from cedar sealed in an epoxy-hardener compound so that the alarm device may operate while submerged.

The applicant's device may be fixed in a leveled state by mechanical adjustment and by using a typical water bubble leveling indication.

DETAILED DESCRIPTION OF THE PREFERRED EMBODIMENT

Figure 1:
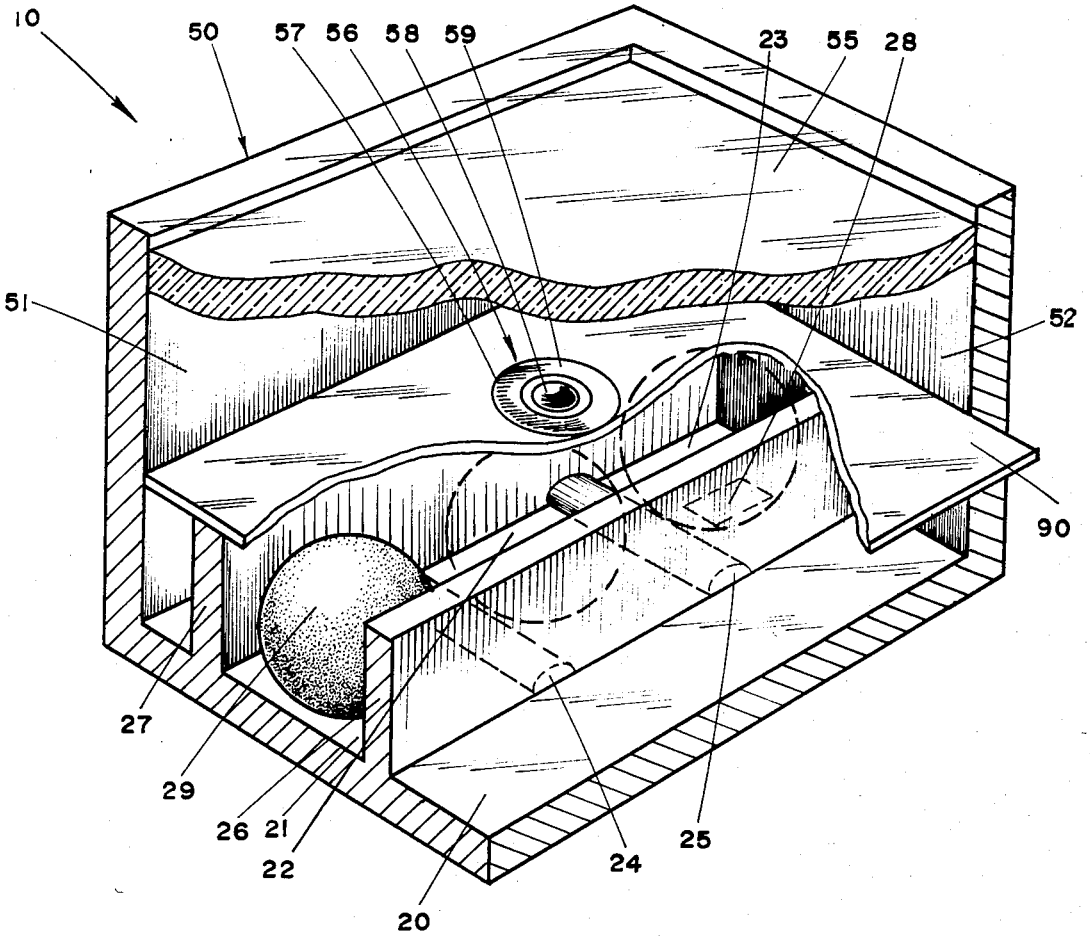
FIG. 1 is a perspective, cutaway view of the preferred embodiment of the applicant's ball actuated alarm device.
Figure 2:
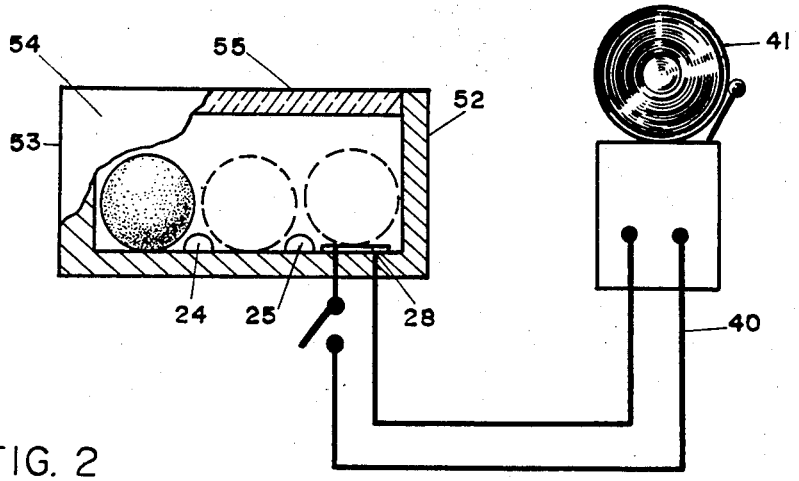
FIG. 2 is a cross-section of FIG. 1 in another cutaway view. The figure further shows an alarm means connected through an electrical circuit attached to the ball actuated alarm device.
Figure 3:
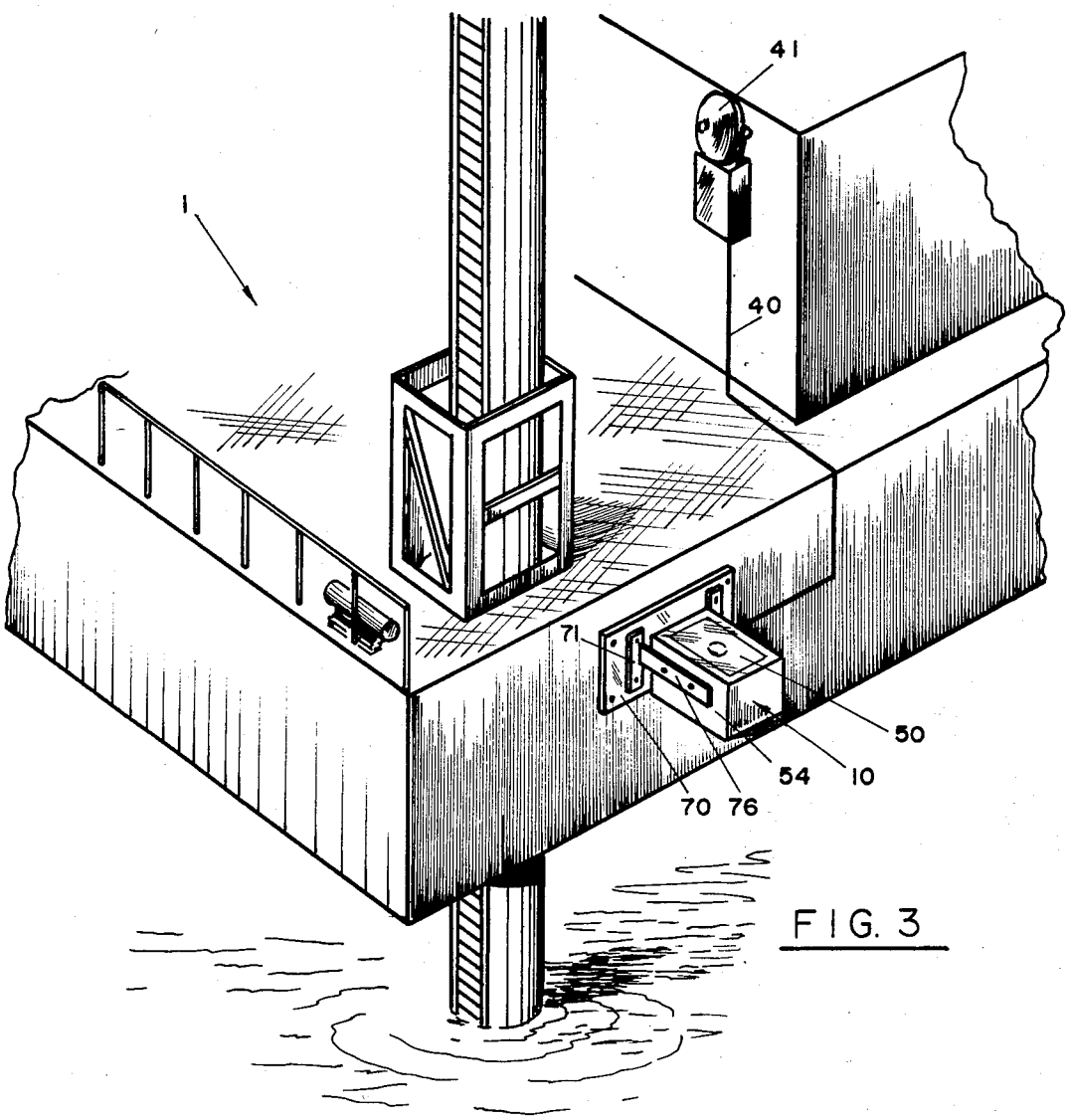
FIG. 3 is a perspective view of the ball actuated alarm device attached to a typical oil rig.
Figure 4:
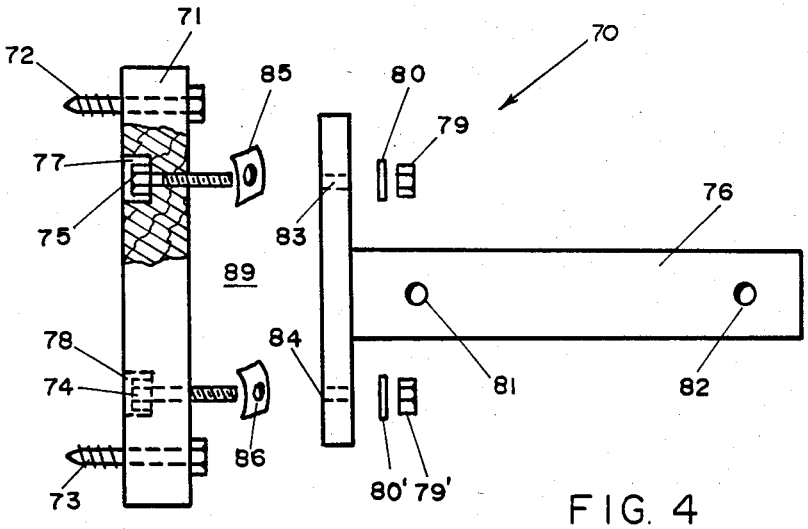
FIG. 4 is a side view of the bracket attachment mechanism used to secure the ball actuated alarm device onto the oil rig.

Referring now to the drawings, wherein like numerals indicate identical or corresponding parts throughout the several views, and more particularly to FIG. 1 thereof, a perspective view of an embodiment of the present invention is depicted. A ball actuated alarm device 10 for attachment to a structure (such as the platform 1 of FIG. 3) for detecting tilting of the structure, generally comprises a rectangular floor plate 20 enclosed in a container 50. The alarm device 10 is wired to a circuit 40 and is adapted to be secured to the structure 1 by the attachment assembly 70 to detect a tilting condition of the structure 1.

Rectangular floor plate 20 is divided into first, second and third regions 21, 22, 23 by first and second protuberances or pins 24, 25 which project upwardly from the floor plate 20, made of lengths of stainless steel cotter key material of semicylindrical shape which are adhered firmly to the floor plate 20 at their flat surfaces. The pins 24, 25 are transversed to a pair of parallel edges 26, 27 made of redwood of the rectangular floor plate 20. The height of the first and second pins 24, 25 of the floor plate 20 is the same, and so are the dimensions of the first, second and third regions 21, 22, 23. A ball actuated pressure sensitive switch or a magnetic reed switch 28 which is coated with plastic lies in the third region 23 of the floor plate 20.

The floor plate 20, is encased in container 50, which comprises perpendicular walls 51, 52, 53, 54, a transparent top 55, and the floor plate 20 itself. The transparent top 55 is made of a hard, thick polycarbonate sheet, such as that manufactured under the trademark, Lexan®. Housed within container 50 is inner transparent cover 90, preferably made of glass, secured to, by adhesive, and in covering relationship to parallel edges 26, 27. Leveling mechanism 56 aids in precise orientation of the floor plate 20. Leveling mechanism 56 is generally known as a spirit level and comprises an air bubble 58 in a liquid 59 encased in a plastic capsule 57, and is secured to inner cover 90 such that the air bubble 58 will be centered on the plastic capsule 57 when the ball actuated alarm device 10 is level. Floor plate 20 and walls 51, 52, 53 and 54 are made of cedar in the preferred embodiment and are covered with an epoxy-hardener compound for waterproofing.

An alarm means 41 is connected in a circuit 40 to the switch 28 for sounding a warning when the switch 28 is actuated and the circuit 40 is closed.

The ball actuated alarm device is attached to the structure 1 by an attachment assembly 70 comprising a wooden member 71 for attachment to the structure 1 by typical sheet metal bolts 72, 73. Wood member 71 is hollow in two places creating hollowed out bolt housings 77, 78 to house square bolts 74, 75 projecting through the wood housing outwardly from the direction of the structure 1 towards an arm member 76. Arm member 76 is attached to wood member 71 and is transverse thereto and is T-shaped. Apertures 83 and 84 are drilled into arm member 76 in order to secure arm member 76 to wood member 71 by engaging bolts 74 and 75. Flexible or compressible washers 85 and 86 tighten and provide variable spacing at the interface 89 between arm member 76 and wooden member 71 in the engaged position. Typical metal washers 80 and 80' and $\frac{3}{8}''$ nuts 79 and 79'; are used to permanently secure the arm member 76 to wood member 71. Apertures 81 and 82 are located in arm member 76 to facilitate the securing of the ball actuated alarm device 10 between a pair of arm members 76. Although the device 10 is secure, adjustment of nuts 79, 79' and flexible washers 85, 86 provide flexibility to level the device 10.

In operation, a metal ball 29 placed in the first region 21 will travel over the first and second pins 24, 25 into the third region 23 during an adequately severe tilt to close a circuit 40 triggering the alarm 41 connected to the circuit so that anyone in the vicinity may be warned of any danger.

Figure 6:
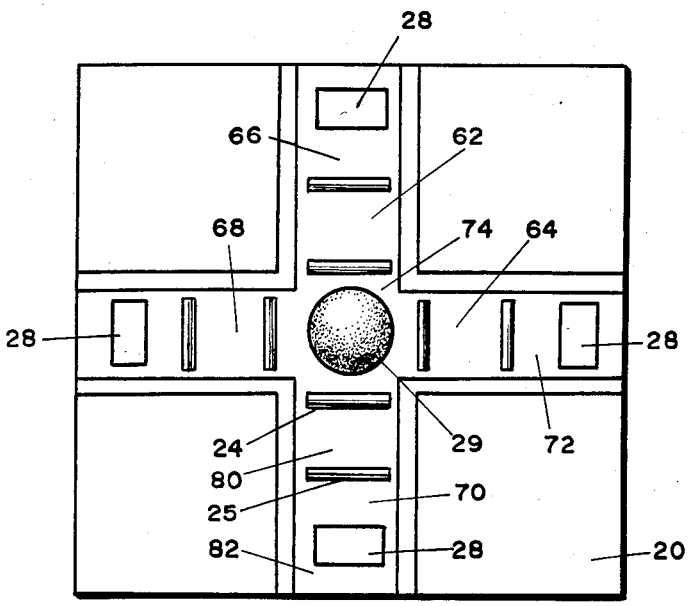
FIG. 6 is a plan view of an another alternate embodiment of the floor plate arrangement of the applicant's device.
Figure 5:
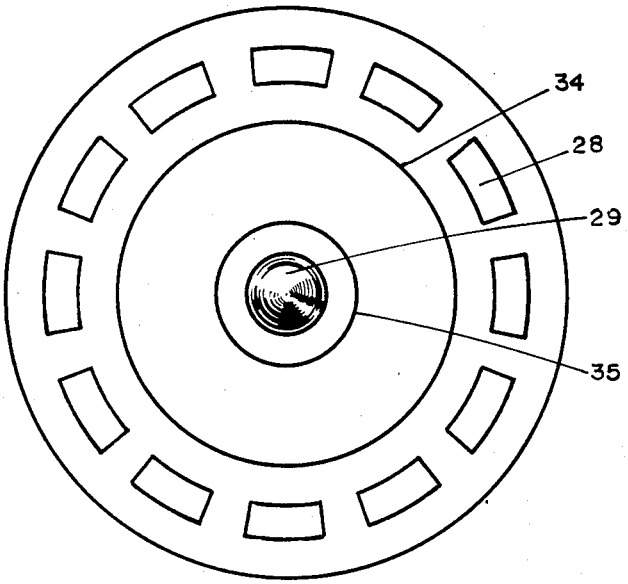
FIG. 5 is a plan view of an alternate embodiment of the floor plate arrangement of the applicant's device.

Alternate embodiments are shown in FIGS. 5 and 6. In FIG. 5, for example, the regions 21, 22, 23 as shown in FIG. 1, may comprise concentric circles defined by annular proturbances 34 and 35 with a circular switch or several switches 28 in the third outermost region for use as a switch. Under this embodiment, tilting in any direction may be detected.

Simply tilting in any of the four general directions can be detected by the embodiment in FIG. 6.

The embodiment in FIG. 6 shows a floor plate 20 made in the form of a square, even though it can be made rectangular or any other suitable form as well.

A pair of channels 62 and 64 are formed on the upper surface of the floor plate and cross each other at mid point. Channels 62 and 64 are substantially perpendicular to each other, having a common midpoint section 74. In such a manner, half channels 66, 68, 70 and 72 are formed in substantially perpendicular relationship to each other and have a common section 74 communicating with all half sections. Each half section, in turn, is divided into a pair of regions, such as 80 and 82 of half channel 70, by two ridges, such as 24 and 25, in half channel 70. The ridges 24 and 25 are similar in intended function to two protuberances 24 and 25 of the first embodiment of this invention and serve as means to prevent movement of the ball from one region to another under normal, aligned conditions. A magnetic switch 28, similar to magnetic switch 28 of the first embodiment of the invention, is positioned in outermost regions of each half channel, so that tilting in four general directions will force the electrically conductive ball 29 to move to either half channel 66 or 68, or 70, or 72 and contact one of the switches 28, thus completing an electrical circuit and signaling an alarm, in case the structure to which the floor plate 20 is attached becomes tilted.

Figure 7:
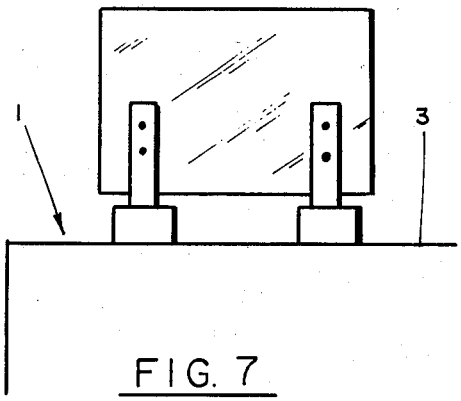
FIG. 7 is a side view of the ball actuated alarm device as mounted on the surface of a platform.

Although the device 10 may be submerged, it may be designed to operate on top 2 of a platform 1 as shown in FIG. 7.

Figure 8:
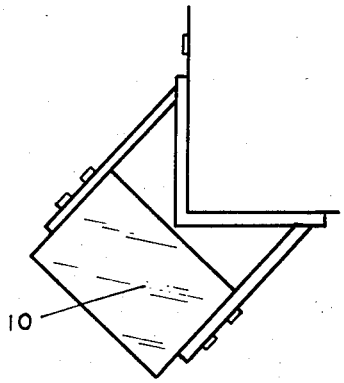
FIG. 8 is a plan view of the ball actuated alarm device mounted to a corner of a platform.

The device 10 may also be mounted on the corner of a platform 1 as shown in FIG. 8.

Modification and variations may be made to the disclosed embodiment without departing from the subject matter of the invention as defined in the following claims.

I claim:

1. A device for detecting a tilted condition of a structure, comprising:

a substantially even floor plate divided into first, second and third regions by first and second protuberances projecting from the floor plate;

a ball supported on said floor plate;

a ball-actuated switch in the third region of the floor plate;

an alarm means in a circuit connected to the switch for signaling a warning when the switch is activated by said ball;

wherein the diameter of said ball is sufficiently greater than the height of the first protuberance to allow the ball to move over the first protuberance and into the second region when the structure to which the device is attached tilts to a predetermined angle; and wherein the second protuberance is of substantially the same height as the first protuberance, so that continued tilt of the structure will move the ball into the third region and activate the alarm.

2. The device of claim 1 wherein the edges of the floor plate are surrounded by guide members to maintain the ball on the floor plate.

3. The device of claim 2 wherein the floor plate is enclosed within a container.

4. The device of claim 3 wherein the container is provided with a transparent top.

5. The device of claim 4 wherein the device is provided with means for attachment to the structure.

6. The device of claim 5 wherein the device is provided with an attachment member transverse to the device, the attachment member secured to the means for attachment to the structure by first and second independently rotatable bolts, the bolts being independently rotated to level the floor plate in a horizontal orientation.

7. The device of claim 6 wherein the protuberances are straight and parallel ridges, the distance between the ridges being substantially equal to the diameter of the ball.

8. The device of claim 7 wherein the floor plate is rectangular, the ridges extend transversely to two parallel edges of the rectangular floor plate, and the dimensions of each region are substantially identical.

9. The device of claim 8 wherein the switch in the third region is a pressure sensitive switch.

10. The device of claim 9 wherein a spirit level is attached to the device.

11. The device of claim 10 wherein the switch in the third region is a magnetically actuated switch and the ball is made of an electrically conductive material.

12. An apparatus for detecting a tilted condition of a structure, comprising:

a substantially even floor plate having a cross-shaped channel means formed by two perpendicularly extending channels, traversing each other adjacent their respective midpoints, thereby forming four half channels and a common, midpoint region, each half channel being divided into two regions by a pair of ridges extending upwardly from the floor plate;

a ball made of an electrically conductive material resting in the common region when the structure is aligned;

a magnetic switch means located in each outermost region of the half channels and electrically connected to an alarm means for signaling a tilted condition of the structure, the alarm means being activated by a contract of the ball and one of said switch means after the ball has reached one of said outermost regions due to the tilted condition of the structure; and means for adjustably securing position of the apparatus in relation to the structure.

13. A method for detecting tilted condition of a structure on water, comprising the steps of:

providing a substantially even floor plate divided into first, second and third regions by first and second protuberances projecting upwardly from the floor plate, said third region having a ball actuated switch;

positioning a ball in said first region to freely roll on said floor plate;

providing an alarm means in a circuit connected to the switch for sounding a warning when the switch is activated and the circuit is closed;

attaching said floor plate onto the structure on water;

wherein said ball has a diameter sufficiently greater than the height of the first protuberance to allow said ball to move over said first protuberance and into said second region when the structure to which the device is attached tilts to a predetermined angle; and wherein said second protuberance is of substantially the same height as said first protuberance, so that continued tilt of the structure will move the ball into said third region and activate said alarm means.

14. An alarm device for detecting a tilted condition of a structure, comprising:

a circular even floor plate divided into first, second and third annular sections by a pair of spaced apart annular ridges extending upwardly from the floor plate;

an electrically conductive ball resting on the floor plate in the first section when the structure is in aligned condition;

a ball actuated switch means mounted in the third section, the switch means comprising a plurality of equidistantly, annularly spaced magnetic switches electrically connected to an alarm means; and means for attaching said device to the structure.

15. The device of claim 14, wherein the means for attaching the device to the structure comprise a means for selectively adjusting position of the device in relation to a vertical plane.

16. The device of claim 14, wherein the means for attaching the device to the structure comprise a container means covering said floor plate, the container means being provided with a transparent wall to facilitate visual observation of position of the ball in relation to the floor plate.

* * * * *